United States Patent [19]

Vikiö

[11] Patent Number: 4,919,796

[45] Date of Patent: Apr. 24, 1990

[54] METHOD AND APPARATUS FOR GRADING FIBER SUSPENSION

[75] Inventor: Pentti A. Vikiö, Kerimäki, Finland

[73] Assignee: A. Ahlstrom Corporation, Noormarkku, Finland

[21] Appl. No.: 235,080

[22] Filed: Aug. 23, 1988

[30] Foreign Application Priority Data

Sep. 1, 1987 [FI] Finland ..... 873780

[51] Int. Cl.[5] ..... B04C 5/10

[52] U.S. Cl. ..... 209/211; 209/12; 241/19; 241/79.1

[58] Field of Search ..... 209/210, 211, 144, 12; 210/512.1, 512.2, 512.3; 241/24, 79.1, 19

[56] References Cited

U.S. PATENT DOCUMENTS

| | | | |
|---|---|---|---|
| 2,590,691 | 3/1952 | Fontein | 209/173 |
| 3,288,286 | 11/1966 | Prins et al. | 209/211 |
| 3,351,195 | 11/1967 | Hukki | 209/211 X |
| 4,134,827 | 1/1979 | Frykhult | 209/211 |
| 4,252,640 | 2/1981 | Musselmann | 209/211 X |

FOREIGN PATENT DOCUMENTS

| | | | |
|---|---|---|---|
| 499912 | 12/1950 | Belgium | 209/211 |
| 537381 | 4/1955 | Belgium . | |
| 138475 | 4/1985 | European Pat. Off. | 209/211 |
| 0186738 | 1/1987 | European Pat. Off. . | |
| 2757581 | 5/1979 | Fed. Rep. of Germany . | |
| 1244745 | 9/1960 | France | 210/512.3 |
| 439301 | 1/1975 | U.S.S.R. | 210/512.3 |
| 1249634 | 10/1971 | United Kingdom . | |
| 2056325 | 3/1981 | United Kingdom . | |

*Primary Examiner*—Donald T. Hajec

*Attorney, Agent, or Firm*—Nixon & Vanderhye

[57] ABSTRACT

A method and apparatus allow the efficient grading of a fiber suspension (e.g. paper pulp) having a consistency of 0.5% or more. A cyclone separator has its rejects outlet connected to a rejects chamber with a solid confining surface. A rotor is mounted for rotation in the rejects chamber adjacent its discharge opening, and accelerates the rotational speed of suspension flowing into the rejects chamber to continue the grading action of the cyclone. Accepts that are discharged from the rejects chamber are recirculated to the inlet to the cyclone separator, while the rejects are passed out for disposal or other action. Vertically extending ribs may be provided along the solid interior walls of the rejects chamber, which act with the rotor to efficiently break up fiber flocks in the suspension. The rotor may include foils which are dimensioned and oriented so as to produce a slight pumping effect on the suspension being rotated to facilitate its discharge through the accepts outlet, upwardly from a middle portion of the rejects chamber.

17 Claims, 2 Drawing Sheets

METHOD AND APPARATUS FOR GRADING FIBER SUSPENSION

BACKGROUND AND SUMMARY OF THE INVENTION

The present inventon relates to a method and apparatus for separating, by means of centrifugal force, coarse and heavy particles from material to be graded. The method in accordance with the invention and the pulp grader, a so called vortex cleaner or cleaner realizing the method, are especially suitable for sorting fiber suspensions in the pulp and paper industry, for example, to separate sand, stones, metallic impurities and like from fiber suspension.

There are many known so called hydrocyclone type cleaners into which pulp to be cleaned is led tangentially into the upper edge of the cylindrical part, whereby the pulp executes a spiral movement circulating downwardly of the wall of the apparatus. At this stage, any heavy impurities, such as stones and metallic particles are drawn under the action of centrifugal force to the outer rim of the turbulent flow against the wall of the apparatus and the lighter material accumulates towards the middle of the apparatus, from where it is discharged most usually via a duct in the upper part of the apparatus having a considerably smaller diameter than the apparatus itself. The heavy material separated from the pump flow is discharged by means of special arrangements via a discharge opening located in the lower part of the apparatus.

In some embodiments, a chamber is arranged protruding downwardly from the lower part of the conical part of a hydrocyclone apparatus and communicating with a duct, which can be closed by a closure device. In the lower part of the chamber there is another closure valve, the opening of which enables the discharge of the chamber. In the normal condition the upper closure device is open and the coarse material being separated flows into the chamber. When the chamber is almost full, the upper closure device is closed and the lower closure device is opened, whereby the material being separated accumulates above the upper closure device. When the chamber is empty the lower closure device is closed and the upper one opened, whereby the material accumulated thereon falls into the chamber.

For example, U.S. Pat. Publication No. 3533506 discloses very specifically problems which are probably encountered when cyclone separators are used. One of the problems, among others, is in the discharge of the cyclone. Particles to be separated by the cyclone can often be of considerable size or otherwise easily clog the discharge opening. When the discharge opening becomes clogged, the rejection or separation of the grader stops and the level of the separated material quickly rises thus filling the cyclone, whereby the particles to be separated are drawn away with the accept pulp. Attempts have been made to prevent or to minimize this clogging of the discharge end of the cyclon, for example, by arrangements in accordance with GB Patent Publication 1249634, which includes both a transverse movable bar extending through a discharge duct into a cyclone cone and an impeller, which both are used in tending to create movement in the separated pulp layer so as to prevent the pulp from clogging the discharge opening of the cyclone, and let the pulp flow uniformly to the discharge duct. The impeller is constructed so as to subject the separated pulp to a force component downwardly towards the discharge opeing, in other words the impeller tends to pump the separated material from the cyclone.

Conventional apparatuses in the present use also have the disadvantage of the filling of the bottom thereof and the stopping of the flow at the bottom of the apparatus, whereby the fractions being separated do not reach the bottom anymore, but are drawn upwards together with the flow of the accept pulp fractions. For the said reason, it has been important with the apparatuses in accordance with the prior art to maintain the level of the accumulated material in the lower part of he apparatus the same or at least below a certain limit so as to prevent the said disadvantageous filling of the bottom.

Additionally, the hydrocyclones, which are used to grade fiber suspensions of the pulp and paper industry, are characterized in that the consistency at which they in accordance with the prior art can treat the pulp, is very low, most usually below 1%, as is stated in the above mentioned US Patent Publication. However, the modern tendency is to reacg continuously higher consistencies in the manufacture processes of pulp and cellulose, which consistencies are in any case clearly above 1%. Thereby the hydrocyclones in their present form make the process more complicated, because all other components connected with the manufacture process can treat thicker pulp, whereby the pulp has to be diluted to the consistency of below 1% before feeding it to the hydrocyclone and has to be thickened it again after the cyclone. This kind of action irrelevant for the actual process involves unnecessary equipment costs and requires treatment, pumping and circulating of considerable amounts of water.

In order to eliminate or minimize said problems and disadvantages, there has been developed a method and apparatus for grading the fiber suspensions in the pulp and paper industry at a consistency which is higher than what is conventionally considered normal. By using the method and apparatus according to the invention it is possible to efficiently separate the heavier impurities from the fiber suspensions upto a consistency of 5%. Thus the apparatus in accordance with the invention is especially suitable, for example, to operate as a presorter for grinders.

The method of grading or removing coarse material from a fiber or pulp suspension in accordance with the invention is characterized in that the rotational speed of the pulp carried to the secondary stage is increased, whereby the accept fraction is separated from the pulp by taking advantage of the centrifugal force and returned back to the pulp circulation, and the reject is discharged from the system.

The apparatus in accordance with the invention is characterized in that a rotatable rotor for accelerating the speed of the rotational movement of the pulp flowing into the reject chamber is arranged in the reject chamber, and that the reject chamber has a discharge duct for the accepted fraction separating from said pulp.

BRIEF DESCRIPTION OF THE DRAWINGS

The invention will be further described below, by way of example, and with reference to the accompanying schematic drawings, in which.

Figure 1:
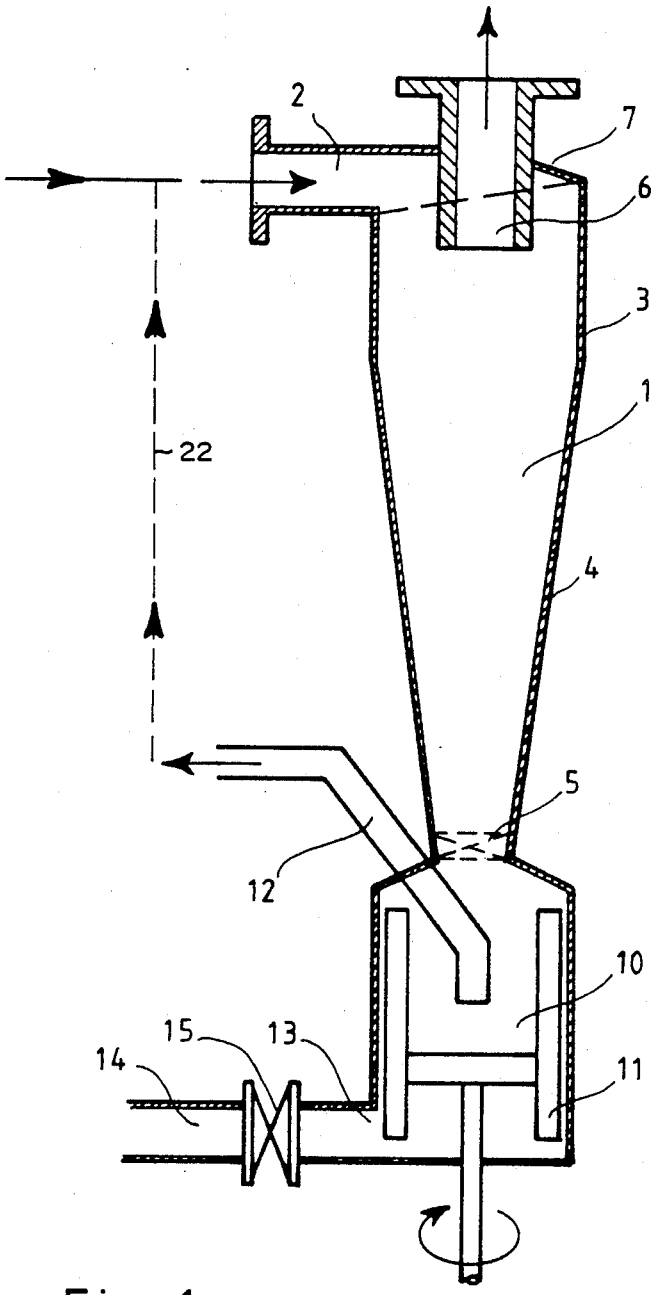
FIG. 1 is a sectional view of an apparatus in accordance with a preferred embodiment connected to a hydrocyclone.

A pulp cleaner or grader in accordance with the invention comprises according to FIG. 1 a cyclone part 1 and a reject chamber 10. The pulp to be treated is led to the cyclone part 1 from the tangential conduit 2, whereby the pulp is caused to execute a circulating movement heading spirally downwards along the cylindrical wall 3 of the cyclone. The wall of the cyclone changes to become conical 4 below the cylindrical wall, whereby the rotational speed of the pulp increases and also the effect of the centrifugal force on the pulp particles increases. Any heavy impurities are separated onto the inner surface of the conical casing 4 of the cyclone 1 and are drawn along the surface to the discharge opening 5 located at the bottom of the conical part and via the discharge opening to the reject chamber 10. When so desired, an intermediate valve can be arranged in the discharge opening 5, by which the reject chamber may be temporarily closed. The finger pulp fraction accumulates around the axis of the cyclone 1 and rises towards the discharge opening 6 for accept on the cover 7 of the cyclone.

The fraction separated from the pulp fed into the cyclone and carried to the reject chamber 10 includes both impurities and acceptable pulp, which should be, if possible, separated from the reject. When the pulp fraction arrives in the reject chamber 10 it is still executing rotational movement, which tends to further separate impurities from the acceptable pulp. Because the diameter of the reject chamber is, however, greater than that of the discharge opening 5 of the reject, the rotational speed of the pulp in the reject chamber decreases substantially. However, a rotor 11 is arranged in the reject chamber 10 in accordance with the invention, which rotor accelerates the rotational speed of the pulp so that the acceptable material in the pulp accumulates in the middle part of the reject chamber 10, from where it can be removed, for example, led back to the pumping chamber, to the feed or like of the sorter, in other words to the cyclone, along the flow duct 12, as via line 22 (see FIG. 1). The rotor thus prevents the pulp fraction supplied from the cyclone to the reject chamber from stopping and prevents the pulp from filling the reject chamber. Due to the more powerful centrifugal force caused by the increased rotational speed, any impurities included in the pulp accumulate at the walls of the reject chamber and flow along the walls to the bottom of the reject chamber 10. The reject is discharged via an opening 13 at the bottom part of the chamber 10, which opening has a valve or closure member 15 in a duct extending from the opening. Thus the invention icludes an improvement in the operation of the reject chamber of the cyclone cleaner by returning acceptable fiber fraction from the flow to the reject chamber back to the feed of the grader and therefore it also includes an increase in the separation efficiency of the device.

Figure 2:
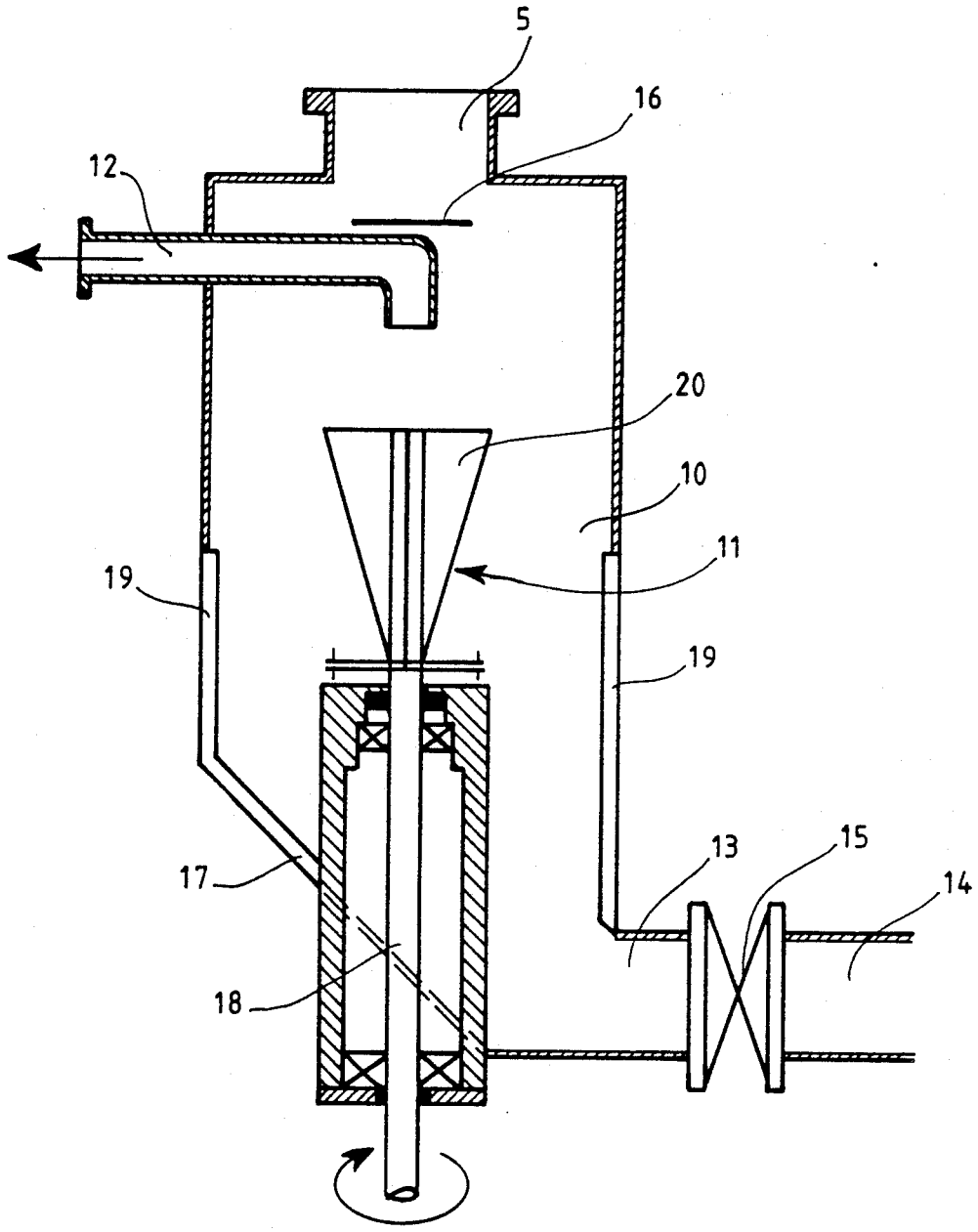
FIG. 2 is an enlarged and more detailed sectional view of an apparatus according to a preferred embodiment.

FIG. 2 discloses in more detail a reject chamber 10 according to a preferred embodiment having the same basic elements as in the apparatus according to FIG. 1, namely: a rotor 11, a return duct 12 for the acceptable fiber fraction, a discharge opening 13 for the reject, a duct 14 and a valve or closure member 15. Additionally, FIG. 2 advantageously shows a counter plate 16 of the vortex located below the discharge opening for the reject in the lower part of the cyclone 1, with which counter plate the flow rising in the middle part of the reject chamber 10 is prevented from rising back into the cyclone and with which on the other hand the primary vortex coming to the reject chamber is rapidly led to the walls of the reject chamber. The return duct 12 for the accptable fiber fraction advantageously opens immediately to below the counter plate of the vortex.

In the case of the apparatus of FIG. 2, rotor 11 is considerably smaller than in case of FIG. 1. According to the drawing, rotor 11 comprises a single or multifoil apparatus rotatably around with the vertical shaft in the reject chamber. The drive of the apparatus is arranged by means of a shaft 18 extending through a bottom 17 of the reject chamber 10. Additionally, this embodiment has ribs 19 arranged on the walls of the reject chamber, the purpose of which is to decrease the turbulence of the impurities rotating about the walls of the reject chamber and thus accelerate their descent to the bottom of the reject chamber 10 adjacent to the discharge opening 13. This accumulation is also intensified by the shape of the bottom 17 of the reject chamber 10 which is inclined towards the discharge opening 13. The reject chamber 10 is emptied by allowing the pulp accumulated in the chamber flow away from time to time or by washing the bottom of the chamber, for example, with water. This kind of arrangement allows several possibilities of adjusting the separation efficiency. It is clear that changing of the rotational speed of the rotor affects the thickness of the reject layer accumulating at the bottom of the reject chamber. It is further possible for the emptying of the reject chamber to be automated, for example, by TIMER-installations or by arranging the measuring of the moment on the shaft of the rotor, whereby a certain moment corresponds a certain height of the reject in the reject chamber. Of course, it is possible to measure the power consumption of the motor rotating the rotor, which gives exactly the same result.

Although the foils 20 of the rotor 11 in FIG. 2 are axial, their direction can deviate therefrom, for example, in such a way that their direction subjects the pulp to a slightly upwards pumping effect, whereby their purpose is not only to provide the pulp flowing to the reject chamber with additional speed, but also to guide acceptable fraction to rise towards the opening of discharge duct 12. Yet another use for the rotor 11 is to break the pulp flocks drawn into the reject chamber 10, which enables the fractionation of pulp to finer and thus a greater amount of the acceptable material flung to the reject can be returned back to the pumping chamber and further back to circulation. The flocks, which the rotor tends to break by subjecting the separated pulp to shear forces in the reject chamber, are not very large or the bonds holding them together are not very tight, thus the energy required for breaking them is not relevant compared to the advantage the improved separation capacity gains. Furthermore, the ribs 19 on the walls of the reject chamber 10 can be used, if so required, also to affect the breaking of the flocks, for example, by extending the foils 20 of the rotor 11 and the ribs 19 to the same axial level and also relatively close to each other, whereby a strong turbulence is effected, which efficiently breaks the fiber flocks. On the other hand, it must also be avoided to effect too much turbulence, because it disturbs the separation of pulp particles.

Although the more detailed embodiment of FIG. 2 discloses a reject chamber with a particular shape and construction, the reject chamber in accordance with the invention can differ considerably from the aforesaid. Depending on the purity rate of the pulp flowing into the reject chamber, the consistency and like factors the rotor can also be similar to that of the FIG. 1 or something between these two embodiments. Further, the ribs on the walls of the reject chamber 10 can be either axial or spiral depending on whether they are desired to operate neutrally, lead the separated material downwards or decelerate as efficiently as possible the rotating flow of separated pulp. As is to be appreciated from the description, the invention can differ a great deal from the above described embodiments and yet not differ from the inventive concept which is disclosed in the accompanying claims, which alone define the scope of invention.

I claim:

1. A method of grading a fiber suspension having a consistency of 0.5% or more utilizing a centrifugal separator having an accepts outlet and rejects outlet, a secondary stage having a second accepts outlet and a second rejects outlet, and mechanical means for increasing the rotational speed of suspension carried to the secondary stage, comprising the steps feeding the suspension with a consistency of 0.5% or more to the centrifugal separator;

effecting separation of the suspension into an accepts fraction and a rejects fraction;

discharging the accepts fraction through the accepts outlet of the separator;

discharging the rejects fraction through the rejects outlet of the separator and feeding it to the secondary stage;

increasing the rotational speed of the rejects fraction of the suspension during discharge to the secondary stage utilizing the mechanical means;

effecting further separation of the rejects fraction in the secondary stage to produce a second accepts fraction and a second rejects fraction;

returning the second accepts fraction to the suspension prior to the suspension being fed into the centrifugal separator through the second accepts outlet;

discharging the secondary rejects from the secondary stage through the second rejects outlet; and preventing the secondary rejects from interfering with the secondary accepts stream, and from blocking discharge of the secondary rejects from the secondary stage, by maintaining the rejects at a substantial rotational speed utilizing the mechanical means.

2. A method as recited in claim 1 wherein during the practice of the separating step in the secondary stage the suspension is subjected to shear forces so that any fiber flocks are broken into smaller flocks or single fibers, which become part of the secondary accepts stream.

3. A method as recited in claim 1 wherein the step of returning the separated secondary accepts is practiced in a continuous, uniform flow.

4. A method as recited in claim 1 wherein the consistency of the suspension fed to the centrifugal separator is between 0.05–5%.

5. Apparatus for grading a fiber suspension, comprising:

a cyclone separator having an accepts outlet and a rejects outlet;

a rejects chamber, having a solid confining surface except an accepts outlet therefrom, and a discharge opening therefrom;

said rejects chamber being connected to said rejects outlet; and means for accelerating the rotational speed of suspension flowing into the rejects chamber, comprising a rotatable rotor mounted for rotation in said rejects chamber adjacent said discharge opening therefrom.

6. Apparatus as recited in claim 5 further comprising means for decelerating the turbulence of impurities in the suspension rotating within the rejects chamber and facilitating movement of the impurities toward said discharge opening, said means comprising ribs disposed interiorly of the rejects chamber on the confining surface.

7. Apparatus as recited in claim 5 wherein said rotor comprises means for producing a slight pumping effect on suspension being rotated thereby, upwardly from the middle thereof, said means comprising a plurality of foils.

8. Apparatus as recited in claim 6 wherein said rotor and said ribs extend to the same axial zone in said rejects chamber so that the turbulence created by said rotor and decelerated by said ribs efficiently breaks any fiber flocks in the suspension.

9. Apparatus as recited in claim 5 wherein said rejects chamber confining surface includes interior walls, and wherein said rotor extends adjacent the walls of said rejects chamber.

10. Apparatus as recited in claim 6 wherein said rejects chamber confining surface has interior walls, and wherein said ribs generally vertically extend along the interior walls of said rejects chamber.

11. Apparatus as recited in claim 6 wherein said rotor comprises means for producing a slight pumping effect on suspension being rotated thereby, upwardly from the middle thereof, said means comprising a plurality of foils.

12. Apparatus as recited in claim 8 wherein said rotor comprises means for producing a slight pumping effect on suspension being rotated thereby, upwardly from the middle thereof, said means comprising a plurality of foils.

13. Apparatus for grading a fiber suspension, comprising:

a cyclone separator having an accepts outlet and a rejects outlet;

a rejects chamber, having interior walls, an accepts outlet therefrom, and a discharge opening therefrom;

said rejects chamber being connected to said rejects outlet;

means for accelerating the rotational speed of suspension flowing into the rejects chamber, comprising a rotatable rotor mounted for rotation in said rejects chamber adjacent said discharge opening therefrom; and means for decelerating the turbulence of impurities in the suspension rotating within the rejects chamber and facilitating movement of the impurities toward said discharge opening, said means comprising ribs disposed on the rejects chamber interior walls.

14. Apparatus as recited in claim 13 wherein said rotor comprises means for producing a slight pumping effect on suspension being rotated thereby, upwardly from the middle thereof, said means comprising a plurality of foils.

15. Apparatus as recited in claim 13 wherein said rotor and said ribs extend to the same axial zone in said rejects chamber so that the turbulence created by said rotor and decelerated by said ribs efficiently breaks any fiber flocks in the suspension.

16. Apparatus as recited in claim 13 wherein said rotor extends adjacent the interior walls of said rejects chamber.

17. Apparatus as recited in claim 13 wherein said ribs generally vertically extend on along the interior walls of said rejects chamber.

* * * * *